US012324495B2

(12) United States Patent
Castillo

(10) Patent No.: US 12,324,495 B2
(45) Date of Patent: Jun. 10, 2025

(54) LOCKABLE SECURE LUNCHBOX

(71) Applicant: Gustavo Castillo, Laredo, TX (US)

(72) Inventor: Gustavo Castillo, Laredo, TX (US)

( * ) Notice: Subject to any disclaimer, the term of this patent is extended or adjusted under 35 U.S.C. 154(b) by 37 days.

(21) Appl. No.: 18/318,810

(22) Filed: May 17, 2023

(65) Prior Publication Data

US 2023/0380559 A1 Nov. 30, 2023

Related U.S. Application Data

(60) Provisional application No. 63/346,546, filed on May 27, 2022.

(51) Int. Cl.

| | |
|---|---|
| ***A45C 11/20*** | (2006.01) |
| ***A45C 13/02*** | (2006.01) |
| ***A45C 13/10*** | (2006.01) |
| ***A45C 13/26*** | (2006.01) |
| ***B65D 21/02*** | (2006.01) |
| ***B65D 25/04*** | (2006.01) |
| ***B65D 25/10*** | (2006.01) |
| ***B65D 55/14*** | (2006.01) |

(52) U.S. Cl.

CPC ..... *A45C 11/20* (2013.01); *A45C 13/02* (2013.01); *A45C 13/1084* (2013.01); *A45C 13/26* (2013.01); *B65D 25/04* (2013.01); *B65D 25/10* (2013.01); *B65D 55/145* (2013.01); *B65D 21/0223* (2013.01); *B65D 2525/288* (2013.01)

(58) Field of Classification Search

CPC ..... A45C 11/20; A45C 13/02; A45C 13/10; A45C 13/1084; A45C 13/26; B65D 21/02; B65D 21/0223; B65D 25/04; B65D 25/10; B65D 33/145; B65D 2525/288; B65D 55/145

USPC ..... 206/1.5, 541, 545, 511, 512

See application file for complete search history.

(56) References Cited

U.S. PATENT DOCUMENTS

| | | | |
|---|---|---|---|
| 1,285,112 | A | 11/1918 | Gaines |
| 2,945,718 | A | 7/1960 | Smith |
| 3,771,822 | A | 11/1973 | Bell |
| 5,427,265 | A | 6/1995 | Cautereels |
| D364,320 | S | 11/1995 | Sipe |

(Continued)

FOREIGN PATENT DOCUMENTS

| | | | | |
|---|---|---|---|---|
| CN | 214759589 U | * | 11/2021 | |
| GB | 2269368 A | * | 2/1994 | ..... A01K 97/06 |
| KR | 1020110070204 A | * | 6/2011 | ..... A45C 11/20 |

*Primary Examiner* — Bryon P Gehman

(74) *Attorney, Agent, or Firm* — Brennan, Manna & Diamond, LLC

(57) ABSTRACT

The present invention relates to a lockable lunchbox made of metal mesh and plastic. The lunchbox comprising a container for storing food items, snacks, beverages and more. The container can be mounted with removable dividers for sorting and separately storing items. A lid pivotally coupled to the container for closing the container using a latch and catch hook. A padlock is used for locking the lid for preventing unauthorized access to the stored items in the container. In some embodiments, a PIN keypad or a fingerprint scanner can be used and the lid has a fold flush handle for easy handling of the lunchbox and storage in a stacked configuration. The lunchbox has a compact design and can be used at school, offices, and more for safely and securely storing and transporting lunch items.

8 Claims, 7 Drawing Sheets

(56) References Cited

U.S. PATENT DOCUMENTS

| | | | | |
|---|---|---|---|---|
| 6,047,976 | A * | 4/2000 | Wang | A45C 11/20 62/457.7 |
| 8,317,046 | B2 * | 11/2012 | Vanderberg | F25D 3/06 220/666 |
| 8,590,704 | B2 * | 11/2013 | Koenig | B65D 21/0228 206/508 |
| 8,875,888 | B2 * | 11/2014 | Koenig | B65D 21/0223 206/508 |
| 10,189,619 | B1 | 1/2019 | Crawley | |
| 2007/0000930 | A1 * | 1/2007 | Kim | A47J 39/00 206/541 |

* cited by examiner

LOCKABLE SECURE LUNCHBOX

CROSS-REFERENCE TO RELATED APPLICATION

The present application claims priority to, and the benefit of, U.S. Provisional Application No. 63/346,546, which was filed on May 27, 2022, and is incorporated herein by reference in its entirety.

FIELD OF THE INVENTION

The present invention relates generally to the field of lunchboxes. More specifically, the present invention relates to a novel lockable lunchbox that is configured to prevent unauthorized access by unauthorized individuals. The lunchbox uses a lock system for locking the lid of the lunchbox to secure the items stored in a container of the lunchbox. The lid includes a handle on the top of the container for convenient carrying, enabling it to fold flush against the lunchbox to store in a stacked form. The padlock ensures that lunches are protected against theft and tampering. Accordingly, the present disclosure makes specific reference thereto. Nonetheless, it is to be appreciated that aspects of the present invention are also equally applicable to other like applications, devices, and methods of manufacture.

BACKGROUND

By way of background, bags and containers for carrying food items and beverages, such as lunchboxes, are popular with individuals who bring their lunches and/or snacks to offices. Usually, lunchboxes are stored in an office refrigerator and are taken out during lunch or snack time. A common occurrence in offices is lunch items being stolen or accidentally misused by other individuals. Conventional lunchboxes do not have a lock and therefore, are easily accessible. Individuals may sift through others' lunch bags looking for different food or beverages, spreading germs and bacteria. Similar problems are faced by children in schools and colleges where the lunchboxes are easily accessed by others for food and beverages. Individuals desire an improved lunchbox wherein contents are not accessible to unauthorized individuals.

Conventional lunchboxes have a small space that may not accommodate beverages. When beverages are kept separately, they are prone to being more easily accessed by other individuals. Further, traditional lunchboxes are soft-sided containers that may lose their shape over time or can be compressed when kept in a bag or in a stacked position causing harm to the stored food items therein. Individuals desire a modified lunch box that has adequate space and is safe and secure to store and transport lunch items.

Individuals (including children) generally remove food items, snacks, and more from their lunchboxes and keep same on a surface such as a table or desk to eat. However, there is a concern about cleanliness of the surfaces in offices, schools, camps, and more and therefore, individuals desire a lunchbox that may allow them to have food without removing items from the lunchbox or alternatively provides a way to clean a surface before placing food items thereon.

It is common for individuals to have the same or similar lunchboxes that increases the possibility of unintentional use of others' lunchbox. It is desired to have a lunchbox that can be personalized thereby preventing others from mistakenly accessing the food items therein.

Therefore, there exists a long felt need in the art for a lunch box that allows individuals to safely and securely store and transport lunch items. There is also a long felt need in the art for an improved lunchbox that cannot be accessed by unauthorized individuals. Additionally, there is a long felt need in the art for a lunchbox that can store multiple food items including beverages. Moreover, there is a long felt need in the art for a lunch items storage box that does not lose its shape and remains stable when kept on a surface. Further, there is a long felt need in the art for a lunchbox that can provide a distinguishable or personalization feature for an individual. Furthermore, there is a long felt need in the art for a lunchbox that can be used at school, offices, and more. Finally, there is a long felt need in the art for a lunchbox that can be easily carried and safely stores food items and beverages by prohibiting any unauthorized use.

The subject matter disclosed and claimed herein, in one embodiment thereof, comprises a secure lunchbox assembly configured to prevent access of stored items therein from unauthorized users. The lunchbox further comprising a body made of plastic enclosing a metal mesh for avoiding deformity in use and storage; said body having a container including upstanding walls from a base, the container having a cavity for storing food items, snacks, and beverages; the body has a lid pivotally coupled to said container for closing the container to secure the stored food items, snacks, and beverages; a latch positioned on the lid and is configured to engage with a catch hook positioned on a front wall of the container; a padlock for locking the lid wherein the padlock locks the latch and the catch to prevent access to unauthorized individuals and to enable access to only authorized users who have the proper keys or combination to open the padlock.

In this manner, the improved lunchbox of the present invention accomplishes all of the forgoing objectives and provides users with a reusable lunchbox designed to safely and securely store and transport lunches at school, offices, and more. The lunchbox has a padlock attached to the front of the lunchbox to prevent it from being opened by unauthorized individuals and has a handle for easy carry that can be folded flush for stacked storage of multiple lunchboxes. The lunchbox is made of a metal mesh covered by plastic, thus, the lunchbox retains its shape and protects the stored food items and beverages therein.

SUMMARY OF THE INVENTION

The following presents a simplified summary in order to provide a basic understanding of some aspects of the disclosed innovation. This summary is not an extensive overview, and it is not intended to identify key/critical elements or to delineate the scope thereof. Its sole purpose is to present some general concepts in a simplified form as a prelude to the more detailed description that is presented later.

The subject matter disclosed and claimed herein, in one embodiment thereof, comprises a secure lunchbox configured to provide access of stored items to only authorized users. The lunchbox further comprising a body made of plastic enclosing a metal mesh for avoiding deformity; said body having a container including upstanding or vertical walls and a base, the container having a cavity for storing food items, snacks, and beverages; the body has a lid pivotally coupled to said container for closing the container to secure the stored food items, snacks and beverages; a latch positioned on the lid is configured to engage with a catch hook positioned on one of the walls of the container;

a padlock for locking the lid wherein the padlock locks the latch and the catch to prevent access to unauthorized individuals while providing access to only authorized users who have proper keys or combination to open the padlock.

In yet another embodiment, the lid is locked using a keypad wherein a user inputs a correct PIN or combination for unlocking the lid to access the stored items in the container.

In yet another embodiment, the lid is locked using a fingerprint scanner wherein a user scans one or more fingerprints for unlocking the lid to access the stored items in the container.

In yet another embodiment, a modified storage box for securing a user's lunch items is disclosed. The storage box has a metal mesh covered with plastic; the storage box further includes a container for storing lunch items; a lid pivotally coupled to the container; the outer surface of the lid has a handle configured to fold flush against the lid; the handle is used for holding the storage box during transportation and fold flush during storage; the container and the lid are configured to lock with each other using a padlock for preventing access of stored lunch items to unauthorized individuals; wherein the container has a plurality of removably placed dividers for separately storing the lunch items; and, an ultraviolet (UV) germicidal lamp for disinfecting the lunch items.

In yet another embodiment, a reusable lunchbox designed to safely and securely store and transport lunches at school, offices, and more is disclosed. The lunchbox includes a container having a front wall, a pair of sidewalls, a rear wall, and a base; said walls extending vertically from sides of the base; a catch hook positioned on the front wall of the container; a lid pivotally coupled along a top edge of the rear wall; the lid having a latch on the front surface wherein the lid is configured to engage with the catch hook; a personalized logo positioned on the exterior surface of the lid; a fold flush handle positioned on the exterior surface of the lid; the latch and the catch hook are locked using at least one of a padlock, a keypad PIN/combination, or a fingerprint scanner for preventing access of food items stored inside the container.

In yet another embodiment, a method of securely storing food items retained in a lunchbox is described. The method comprising the steps of: providing a lockable lunchbox having a container and a lid; storing food items in the container; locking the container and the lid using a padlock; storing the lunchbox at any convenient place; unlocking the container using an unlocking mechanism of the padlock; and securely accessing the stored food items.

Numerous benefits and advantages of this invention will become apparent to those skilled in the art to which it pertains upon reading and understanding of the following detailed specification.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and are intended to include all such aspects and their equivalents. Other advantages and novel features will become apparent from the following detailed description when considered in conjunction with the drawings.

BRIEF DESCRIPTION OF THE DRAWINGS

The description refers to provided drawings in which similar reference characters refer to similar parts throughout the different views, and in which.

DETAILED DESCRIPTION OF THE PRESENT INVENTION

Figure 1:
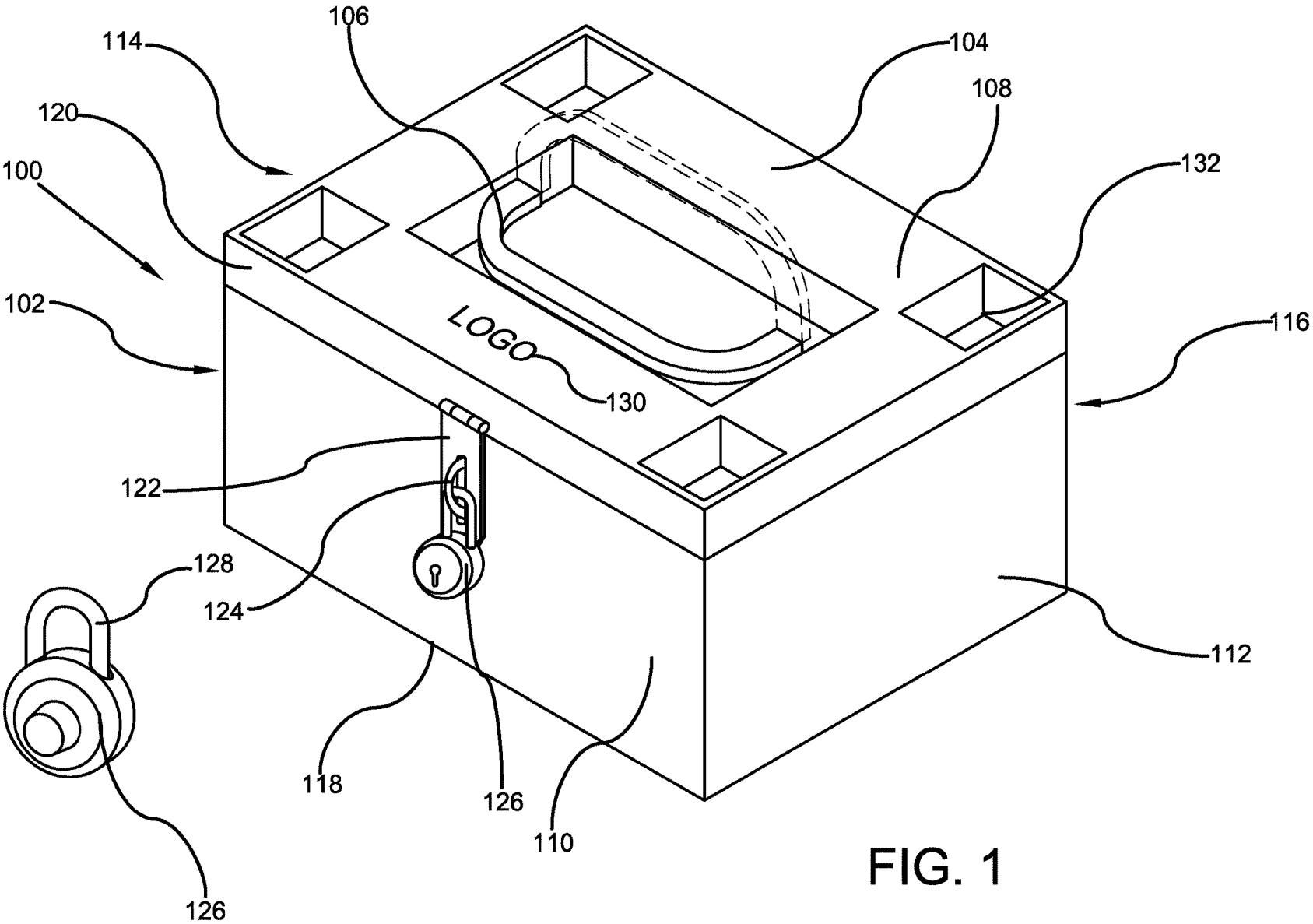
FIG. 1 illustrates a perspective view of one potential embodiment of the secure lunchbox of the present invention in a closed state in accordance with the disclosed architecture.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form in order to facilitate a description thereof. Various embodiments are discussed hereinafter. It should be noted that the figures are described only to facilitate the description of the embodiments. They are not intended as an exhaustive description of the invention and do not limit the scope of the invention. Additionally, an illustrated embodiment need not have all the aspects or advantages shown. Thus, in other embodiments, any of the features described herein from different embodiments may be combined.

As noted above, there is a long felt need in the art for a lunchbox that allows individuals to safely and securely store and transport lunch items. There is also a long felt need in the art for an improved lunchbox that cannot be accessed by unauthorized individuals. Additionally, there is a long felt need in the art for a lunchbox that can store multiple food items including beverages. Moreover, there is a long felt need in the art for a lunch items storage box that does not lose its shape and remains stable when kept on a surface. Further, there is a long felt need in the art for a lunchbox that can provide a distinguishable or personalization feature for an individual. Furthermore, there is a long felt need in the art for a lunchbox that can be used at school, offices, and more. Finally, there is a long felt need in the art for a lunchbox that can be easily carried and safely stores food items and beverages by eliminating any unauthorized use.

The present invention, in one exemplary embodiment, is a modified storage box for securing a user's lunch items. The storage box has a metal mesh covered with plastic, the storage box further includes a container for storing lunch items, a lid pivotally coupled to the container, the outer surface of the lid has a handle configured to fold flush against the lid, the handle is used for holding the storage box during transportation and folds flush during storage, the container and the lid are configured to lock with each other using a padlock for preventing access of stored lunch items to unauthorized individuals, wherein the container has a plurality of removably placed dividers for separately storing the lunch items, and a UV germicidal lamp for disinfecting the lunch items.

Referring initially to the drawings, FIG. 1 illustrates a perspective view of one potential embodiment of the secure lunchbox of the present invention in a closed state in accordance with the disclosed architecture. The secure lunchbox 100 of the present invention is configured for storing food items, beverages, and more in a secure and leak-tight manner. More specifically, the lunchbox includes a container 102 for storing food items and has a hinged closure lid 104 for closing the container 102 in a leak-tight manner. The closure lid 104 has a handle 106 that is configured to be folded flush against the top surface 108 of the lid 104. The handle 106 is used for holding the lunchbox 100 during transportation (in the orientation of the handle shown in dotted lines) and kept in a folded flush position (as shown in solid lines) during storage such as in a refrigerator.

The container 102 is generally rectilinear or square in one exemplary embodiment but can be of any geometric shape such as oval, circular, elliptical, or the like. In the present embodiment, the container 102 has a front wall 110, a pair of side walls 112, 114, and a rear wall 116. The walls extend vertically from a base 118 in an upstanding configuration to form a cavity for storing the food items, beverages, snacks, and more. The front face 120 of the closure lid 104 has a latch 122 and the front wall 110 has a catch 124. The latch 122 is configured to be latched to the catch 124 and can be locked using a padlock 126. The padlock 126 can be any conventional closed shackle padlock, circular padlock, long shackle padlocks, cable lock, and the like. For securing the closure lid 104, the shackle 128 of the padlock 126 is engaged through the catch 124 to lock the latch 122. The padlock 126 prevents the contents stored inside the container 102 from being accessed by unauthorized individuals and therefore, enables secure storage of food items, snacks, and beverages therein.

The top surface 108 of the lid 104 can have a logo or any other indicia 130 such as name of owner of the lunchbox 100 for uniquely identifying the lunchbox 100 and prevent same from being stolen or misplaced. The lunchbox 100 can be available in different sizes and colors and retains its shape even when stored in a stacked orientation/formation. The top surface 108 can have a plurality of recesses 132 for creating 3D cavities.

Figure 2:
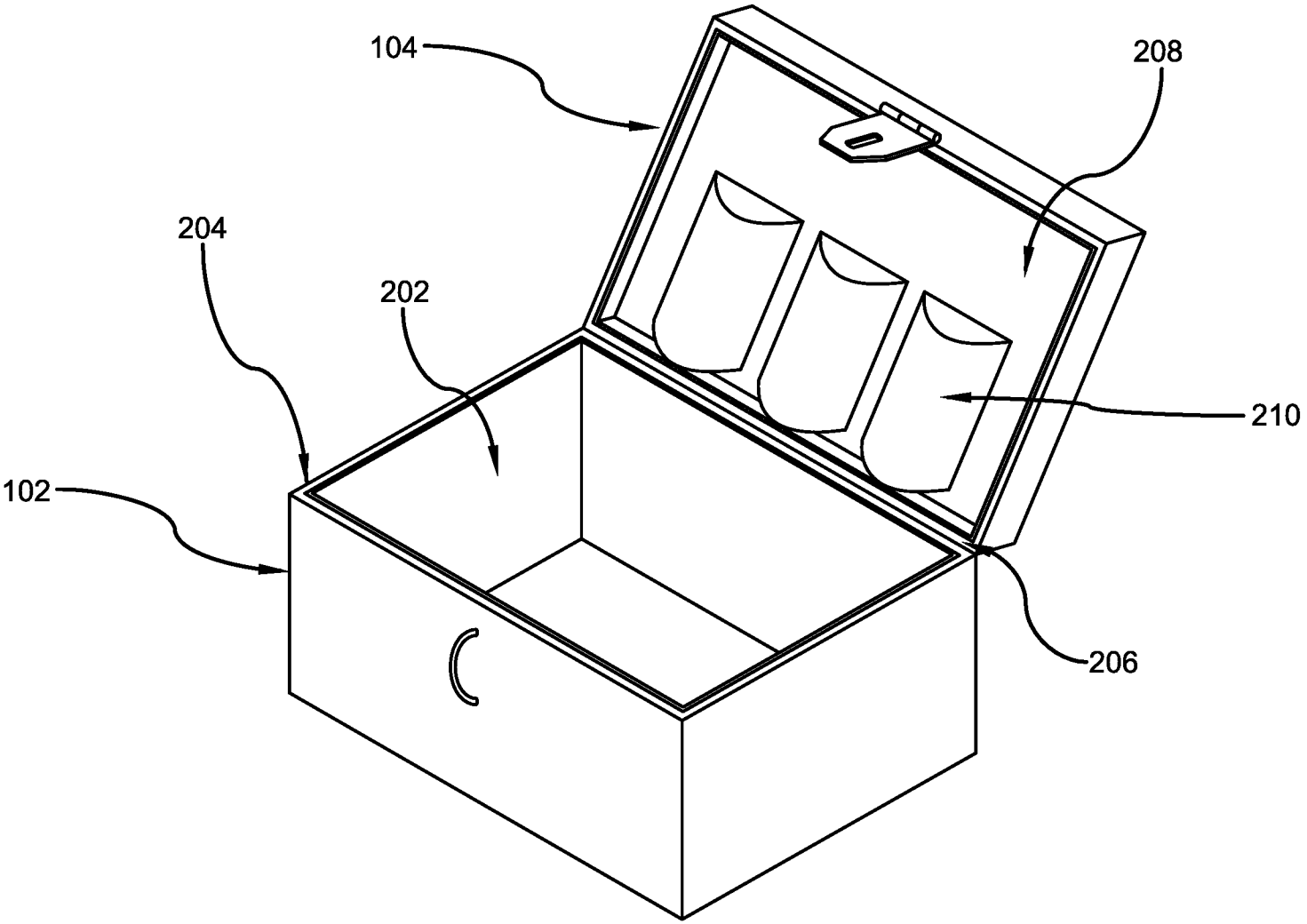
FIG. 2 illustrates a perspective view of the secure lunchbox of one potential embodiment of the present invention in an open configuration in accordance with the disclosed architecture.

FIG. 2 illustrates a perspective view of the secure lunchbox of one potential embodiment of the present invention in an open configuration in accordance with the disclosed architecture. The lunchbox 100 is preferably made of a metal mesh 202 that forms the interior of the lunchbox 100 and has a layer of plastic cover 204 covering the metal mesh 202. The plastic cover 204 prevents the outer surface from getting cold when the lunchbox 100 is kept in a refrigerator. The metal mesh 202 and the plastic cover 204 are integrally attached using an adhesive disposed therebetween.

The closure lid 104 is hinged along the common edge 206 enabling pivotal movement of the lid 104 relative to the container 102, wherein the lid 104 is further configured to make a maximum of 150 degree angle during upward pivotal movement along the edge 206. The container 102 is used for storing food items, snacks, beverages, and more. The inner surface 208 of the lid 104 has a plurality of pockets 210 for storing cutlery or napkins. The napkins can be used for cleaning a surface before putting food items thereon and thus enables a clean and hygienic surface. The container 102 can have removable dividers for separating items stored therein as described later in the disclosure.

Figure 3:
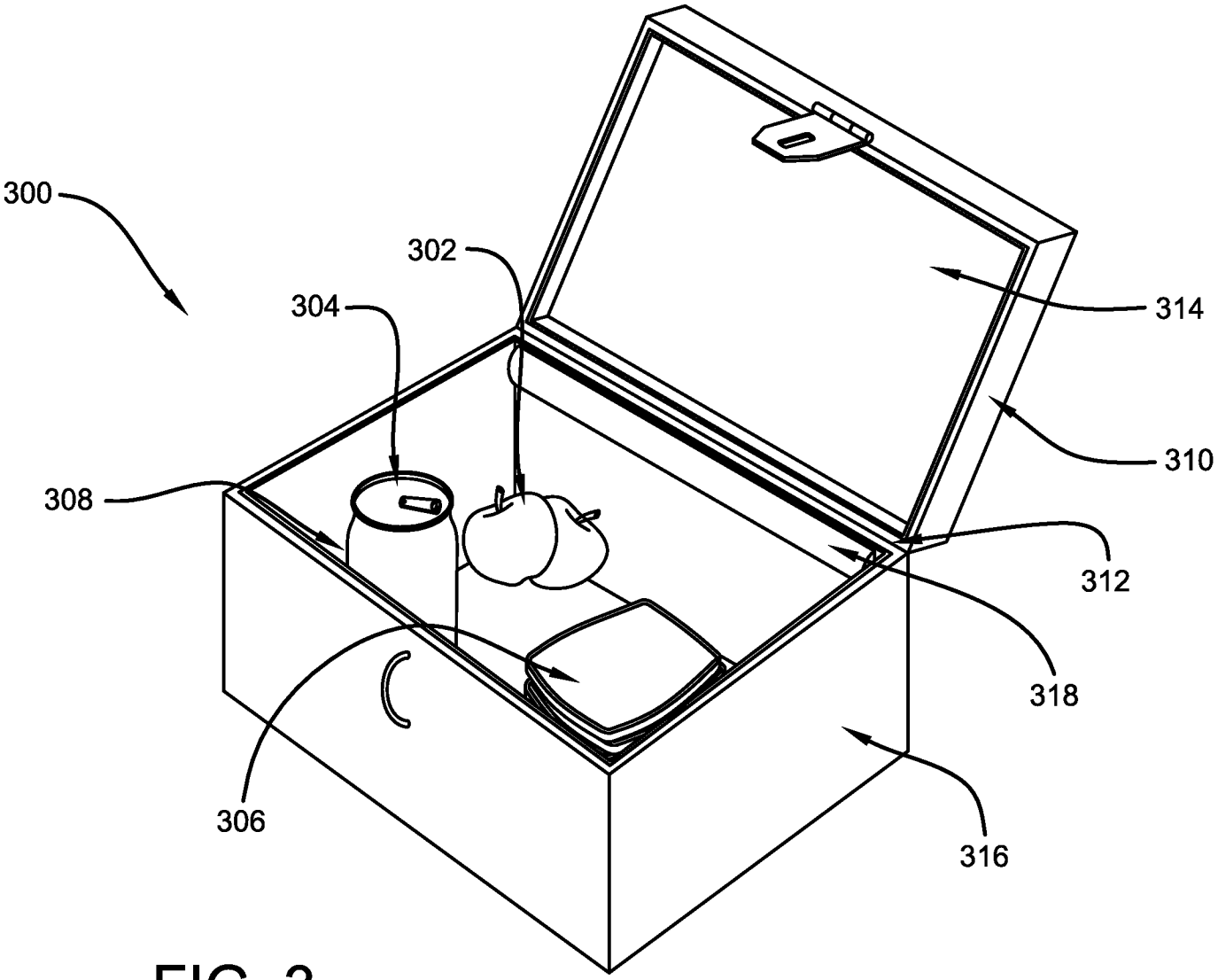
FIG. 3 illustrates a perspective view showing food items, snacks, and beverages stored in the lunchbox in accordance with the disclosed architecture.

FIG. 3 illustrates a perspective view showing food items, snacks, and beverages stored in the lunchbox in accordance with the disclosed architecture. The secure lunchboxes of various embodiments are large enough to store a plurality of items safely that can also allow a user to have food, snacks, and beverages all retained therein. As illustrated in the present embodiment, the lunchbox 300 stores fruits 302, beverages 304, and snacks 306 inside the container 308 while the lid 310 pivotally moves along the edge 312.

The metal mesh 314 supports the stored items without any damage while the exterior plastic or silicone cover 316 may protect the other adjacent items when the lunchbox 300 is kept inside a refrigerator or on any other surface. It should be noted that the specifications of construction of the lunchboxes of various embodiments are similar with the interior metal mesh and outer silicone or plastic. In the present embodiment, the lunchbox 300 can have a germicidal UV lamp 318 for disinfecting stored items.

Figure 4:
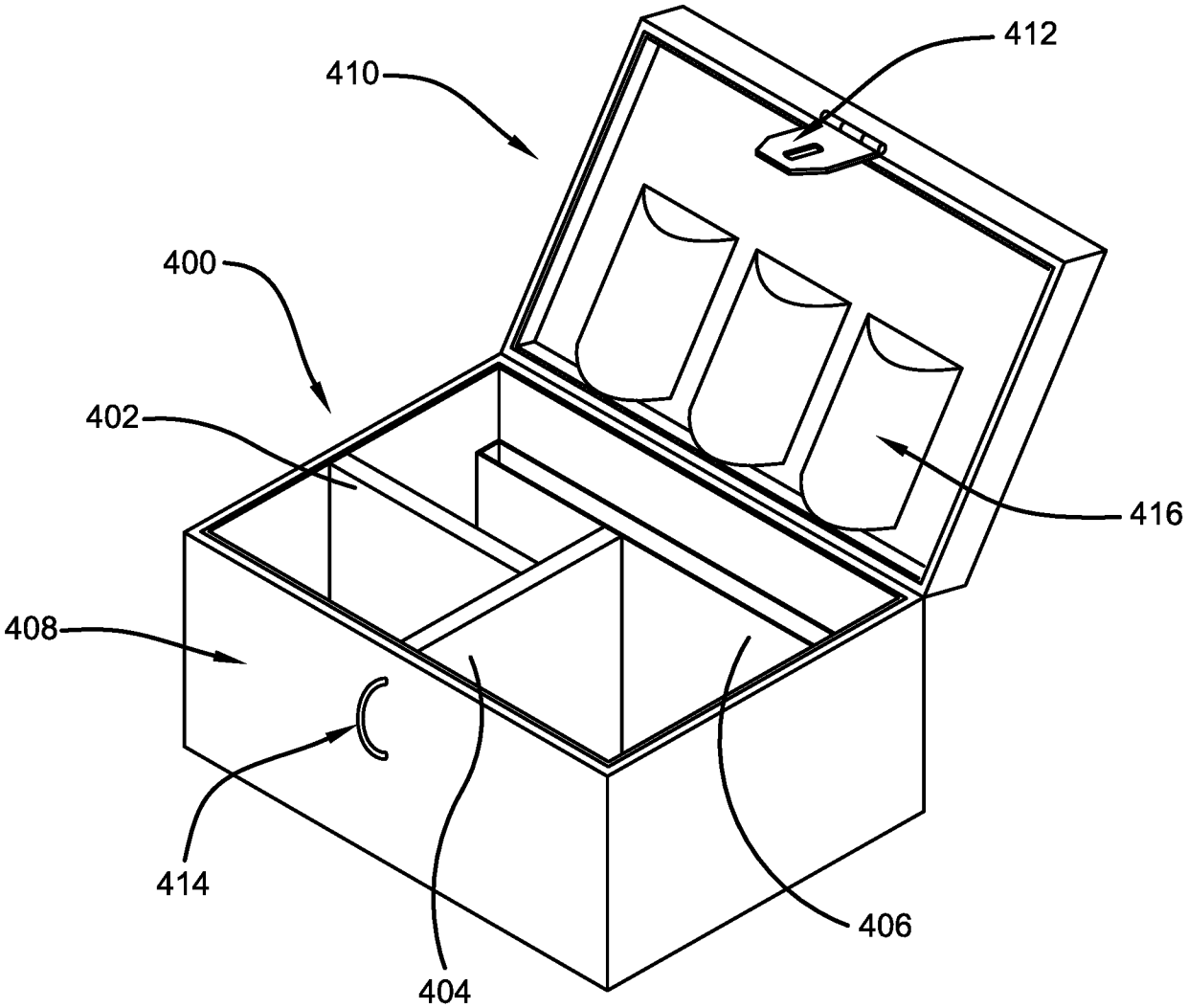
FIG. 4 illustrates a perspective view of yet another embodiment of the secure food storing container of the present invention in accordance with the disclosed architecture.

FIG. 4 illustrates a perspective view of yet another embodiment of the secure food storing container of the present invention in accordance with the disclosed architecture. In the present embodiment, the lunchbox 400 has a plurality of dividers 402, 404, 406 removably placed inside the container 408 for separately storing the food and other items. The container 408 may or may not have panels for accommodating the dividers 402, 404, 406 and the dividers may be secured between any of the two walls of the container 408 or between a wall and another divider or between two dividers. The dividers may be made from insulating plastic or wooden material and are securely placed on the metal mesh.

Height and thickness of the dividers can be based on the preferences of a user and allow easy closure of the lid 410 for closing the container 408. As in other embodiments, the lunchbox 400 has pockets 416 for securing additional items such as cutlery. The latch 412 and catch 414 are used for securing the lid 410 using a padlock which is a common and important feature in all the embodiments of the present invention.

Figure 5:
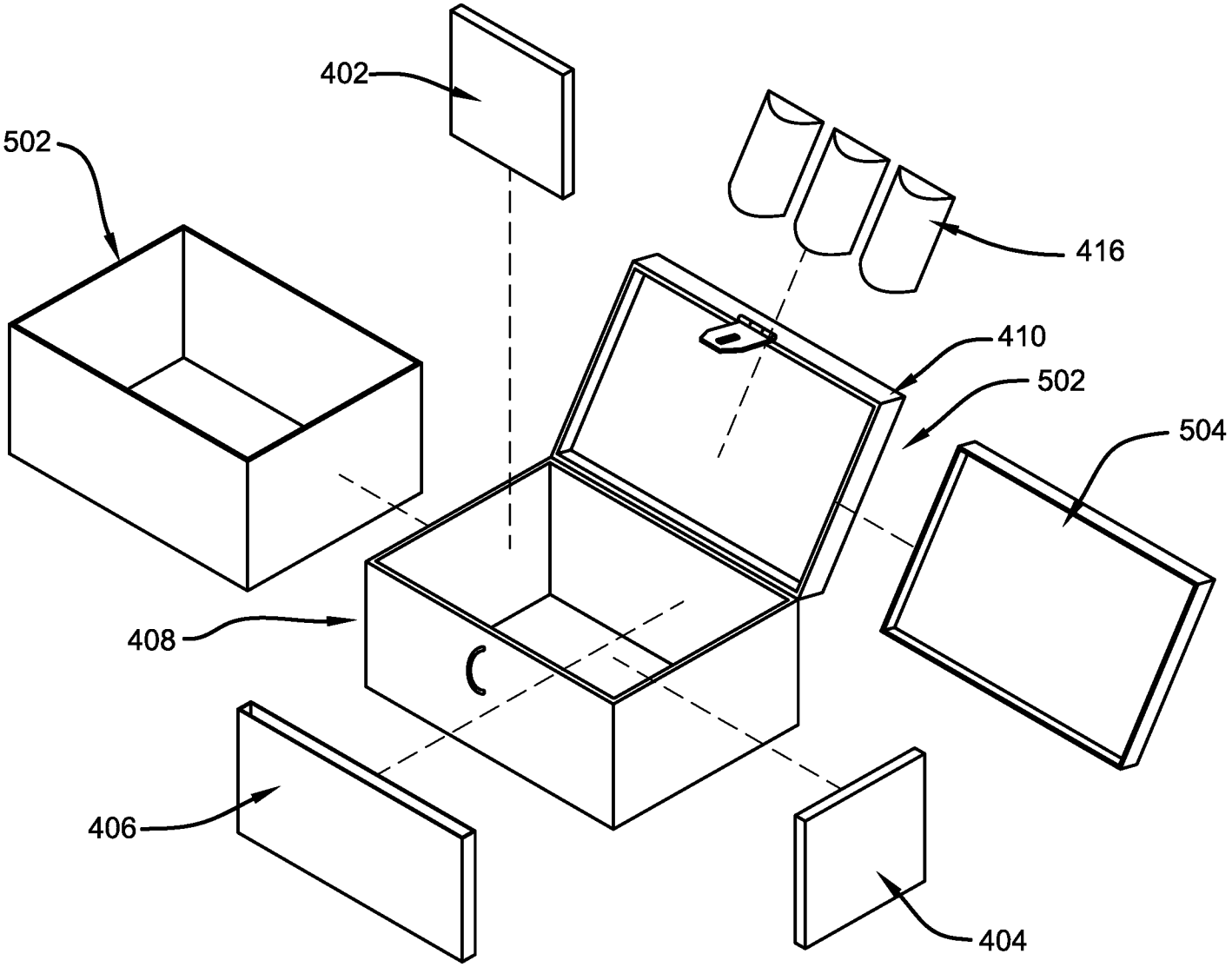
FIG. 5 illustrates an exploded view of the secure lunchbox of FIG. 4 in accordance with the disclosed architecture.

FIG. 5 illustrates an exploded view of the secure lunchbox of FIG. 4 in accordance with the disclosed architecture. As illustrated, the plastic cover 502 forming the body of the lunchbox 400 encloses a first metal mesh 504 for container 408 and a second metal mesh 506 for forming the lid 410. The metal mesh may be integrated or can be removed and replaced with other metal mesh. The dividers 402, 404, 406 are removably placed in any desired orientation in the container 408 and can be stably placed between the walls of the container 408. The pockets 416 are attached to the metal mesh 506 using, for example, adhesive and can be of same or different sizes and shapes.

Figure 6:
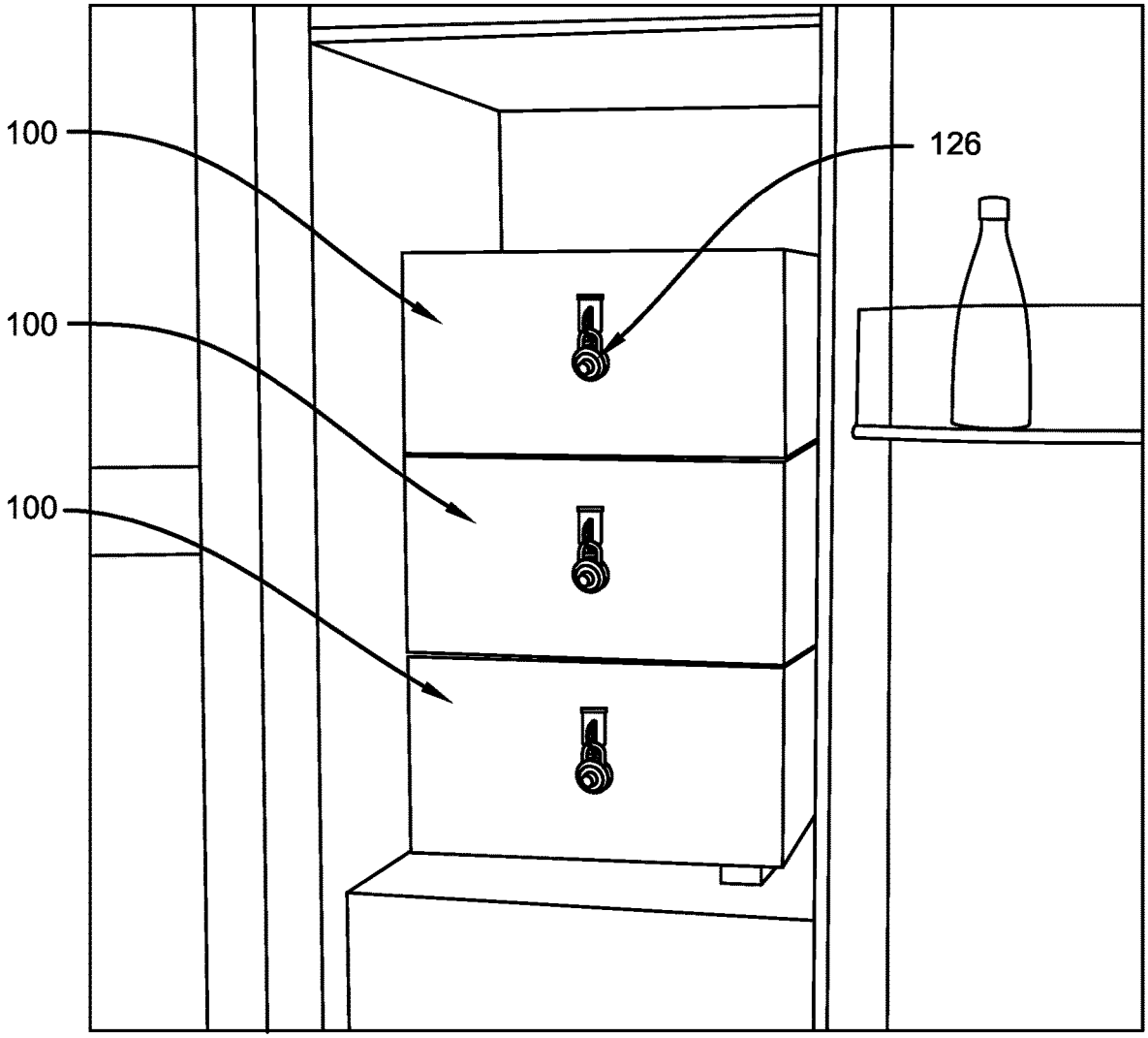
FIG. 6 illustrates a perspective view showing the lunchboxes of the present invention in a stacked form in accordance with the disclosed architecture.

FIG. 6 illustrates a perspective view showing the lunchboxes of the present invention in a stacked orientation in accordance with the disclosed architecture. The exterior appearance and structure of all the embodiments of the secure lunchbox of the present invention are similar and the handle on the exterior surface of the lid is configured to fold flush against the lunchbox. For storing the lunchboxes in a stacked manner, the handle of each lunchbox 100 is folded flush as illustrated in FIG. 1 such that the base of one lunchbox can be positioned on top of the lid of another lunchbox. The logo or indicia on the top of the lid can be used as an identifying means and further, the padlock 126 allows only an authorized user to open the lid and access the items stored in the container. In some embodiments of the present invention, the lunchbox can have a strap enabling a user to carry the lunchbox on a shoulder.

In use, food items are placed in the lunchbox and the lid is closed to facilitate the padlock closure with the lid. In this way the food items in the lunchbox are secured such that unauthorized users are prohibited from accessing the food items. The padlock is unlocked to open the lid and retrieve the food items to be eaten. In this way the lunchbox ensures that only the owner of the lunchbox can access the food items therein.

In some embodiments, the padlock can have a keyhole for receiving a key thereby facilitating the lock to be moved between the locking condition and the unlocking condition. In some embodiments, the lunchbox can have a light (i.e., LED) in addition to the UV germicidal lamp wherein the LED can illuminate when the lock is unlocked and the lid is opened. The LED enables a person to access the food items even in low light and dark areas.

Figure 7B:
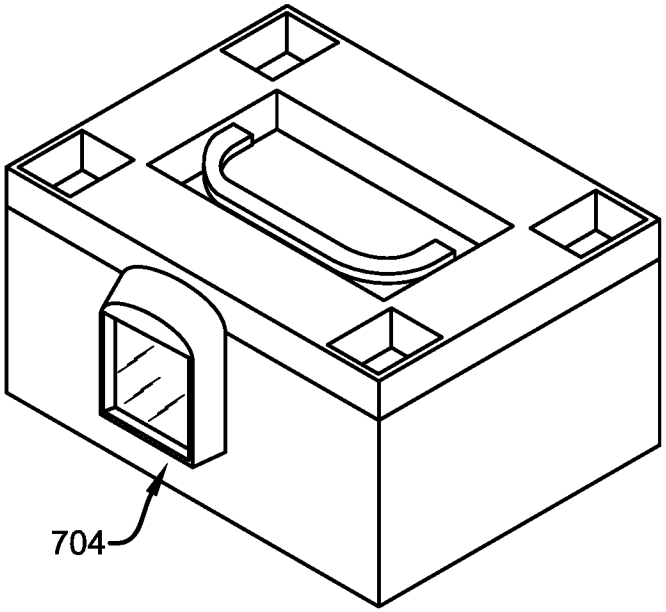
FIG. 7B illustrates a perspective view of a lunchbox equipped with a fingerprint scanner in accordance with the disclosed architecture.
Figure 7A:
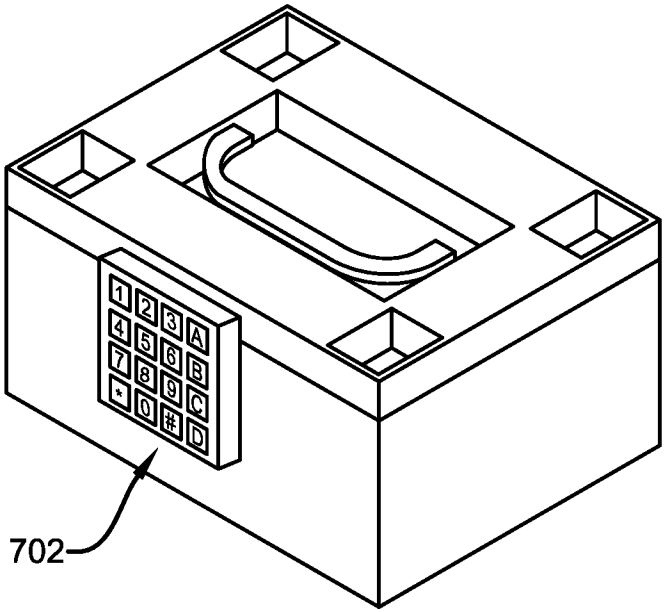
FIG. 7A illustrates a perspective view of a lunchbox equipped with a keypad in accordance with the disclosed architecture.

In some embodiments, in place of the padlock the lunchbox can have a keypad 702 for entering a PIN as illustrated in FIG. 7A or can have a fingerprint scanner 704 for scanning a fingerprint as illustrated in FIG. 7B for authenticating a user for providing access to the stored food items.

Certain terms are used throughout the following description and claims to refer to particular features or components. As one skilled in the art will appreciate, different persons may refer to the same feature or component by different names. This document does not intend to distinguish between components or features that differ in name but not structure or function. As used herein "secure food storing container", "secure lunchbox", "lunchbox", "storage box", and "lunch bag" are interchangeable and refer to the lockable secure lunchbox 100, 300, 400 of the present invention.

Notwithstanding the forgoing, the lockable secure lunchbox 100, 300, 400 of the present invention can be of any suitable size and configuration as is known in the art without affecting the overall concept of the invention, provided that it accomplishes the above stated objectives. One of ordinary skill in the art will appreciate that the lockable secure lunchbox 100, 300, 400 as shown in the FIGS. are for illustrative purposes only, and that many other sizes and shapes of the lockable secure lunchbox 100, 300, 400 are well within the scope of the present disclosure. Although the dimensions of the lockable secure lunchbox 100, 300, 400 are important design parameters for user convenience, the lockable secure lunchbox 100, 300, 400 may be of any size that ensures optimal performance during use and/or that suits the user's needs and/or preferences.

Various modifications and additions can be made to the exemplary embodiments discussed without departing from the scope of the present invention. While the embodiments described above refer to particular features, the scope of this invention also includes embodiments having different combinations of features and embodiments that do not include all of the described features. Accordingly, the scope of the present invention is intended to embrace all such alternatives, modifications, and variations as fall within the scope of the claims, together with all equivalents thereof.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A lunchbox container for storing food items, the lunchbox container comprising:

a container having a hinged closure lid, a foldable handle, and a handle recess in said lid for selectively folding said foldable handle into said handle recess;

wherein said container having a plurality of container walls including a front wall, a pair of side walls, and a rear wall extending vertically from a base for forming a storage cavity;

wherein said lid having a front face and a latch mounted to said front face;

wherein said front wall having a catch for mating with said latch;

a lock for locking said catch and said latch;

said plurality of container walls having a container wall removable metal mesh inner layer and a container wall plastic outer layer; and wherein said lid having a lid removable metal mesh inner layer and a plastic lid outer layer; and wherein said lid further comprises a plurality of recesses in a top of said lid, each recess configured to engage a portion of a base of a second container to stack the second container on top of the container and retain a shape of the first and second containers in a stacked orientation.

2. The container for storing food items of claim 1, wherein said container having a germicidal UV lamp for disinfecting stored items in said container.

3. The container for storing food items of claim 2, wherein said lock is selected from a group consisting of a padlock, a closed shackle padlock, a circular padlock, a long shackle padlock, and a cable lock.

4. The container for storing food items of claim 2, wherein said lid pivotally rotatable relative to said container, and further wherein said lid having a maximum 150 degree angle rotatable to said container.

5. The container for storing food items of claim 2, wherein said lid having an inner surface including a plurality of pockets for storing cutlery.

6. The container for storing food items of claim 2, wherein said container having a plurality of removable dividers for separating items stored in said container.

7. The container for storing food items of claim 6, wherein said plurality of removable dividers having a material selected from insulated plastic or wood.

8. The container for storing food items of claim 2, wherein said plastic outer layer of said plurality of container walls and said plastic outer layer of said lid are silicone.

* * * * *